US008958736B2

(12) United States Patent
Lee et al.

(10) Patent No.: US 8,958,736 B2
(45) Date of Patent: Feb. 17, 2015

(54) FIXING APPARATUS AND ELECTROPHOTOGRAPHIC IMAGE FORMING APPARATUS INCLUDING THE SAME

(71) Applicant: SAMSUNG Electronics Co., Ltd., Suwon-si, Gyeonggi-do (KR)

(72) Inventors: Sun-hyung Lee, Yangyang-gun (KR); Ju-hyeong Lee, Busan (KR); Sang-uk Jeon, Yongin-si (KR)

(73) Assignee: SAMSUNG Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 14/014,508

(22) Filed: Aug. 30, 2013

(65) Prior Publication Data

US 2014/0294471 A1 Oct. 2, 2014

(30) Foreign Application Priority Data

Mar. 26, 2013 (KR) ..... 10-2013-0032358

(51) Int. Cl.
*G03G 15/20* (2006.01)

(52) U.S. Cl.
CPC ..... *G03G 15/2053* (2013.01)
USPC ..... 399/333; 399/330

(58) Field of Classification Search
None
See application file for complete search history.

(56) References Cited

U.S. PATENT DOCUMENTS

2004/0265020 A1* 12/2004 Aruga ..... 399/329
2007/0242988 A1* 10/2007 Seo et al. ..... 399/328

* cited by examiner

*Primary Examiner* — Clayton E Laballe
*Assistant Examiner* — Jas Sanghera
(74) *Attorney, Agent, or Firm* — Staas & Halsey LLP

(57) ABSTRACT

A fixing apparatus includes a heating roller and a nip forming unit facing the heating roller to form a fixing nip. The heating roller includes a resistive heating layer receiving an electric current to generate heat, and a base material supporting the resistive heating layer, wherein a resistance per unit length of the resistive heating layer at opposite sides in a length direction is less than a resistance per unit length of the resistive heating layer at a center portion.

20 Claims, 7 Drawing Sheets

FIXING APPARATUS AND ELECTROPHOTOGRAPHIC IMAGE FORMING APPARATUS INCLUDING THE SAME

CROSS-REFERENCE TO RELATED APPLICATIONS

This application claims priority under Korean Patent Application No. 10-2013-0032358, filed on Mar. 26, 2013, in the Korean Intellectual Property Office, the disclosure of which is incorporated herein in its entirety by reference.

BACKGROUND

1. Field

The present general inventive concept relates to a fixing apparatus adopting a resistive heating layer, and an electrophotographic image forming apparatus.

2. Description of the Related Art

An electrophotographic image forming apparatus supplies toner to an electrostatic latent image formed on an image receptor to form a visual toner image on the image receptor, transfers the toner image to a recording medium, and fixes the transferred toner image to the recording medium. Toner is manufactured by adding various functional additives such as a coloring agent to a base resin. A fixing process includes a process of applying heat and pressure to the toner.

Generally, a fixing apparatus includes a heating roller and a pressing roller engaging with each other to form a fixing nip. While the recording medium, to which the toner is transferred, passes through the fixing nip, heat and pressure are applied to the toner. A heat source such as a halogen lamp is disposed on a center portion of a cylindrical heating roller to heat the heating roller via convection and radiation using air as a medium. In such a fixing apparatus, since heat is transferred from the heat source to the heating roller via the air as a medium, it is difficult to expect high heat efficiency. Additionally, the halogen lamp emits a substantial amount of visible rays that are not very effective to provide heat in comparison to infrared light. Thus, a substantial amount of power is consumed. Furthermore, since a heat capacity of such a heating roller is high, a rapid rise in its temperature may not be easily obtained.

SUMMARY

The present general inventive concept provides a fixing apparatus having an improved thermal efficiency by adopting a surface heating method and an electrophotographic image forming apparatus.

The present general inventive concept also provides a fixing apparatus to prevent over-heating of a non-pass region through which recording media do not pass, and an electrophotographic image forming apparatus.

Additional features and utilities of the present general inventive concept will be set forth in part in the description which follows and, in part, will be obvious from the description, or may be learned by practice of the general inventive concept.

According to exemplary embodiments of the present general inventive concept, a fixing apparatus includes a heating roller that has a resistive heating layer receiving an electric current to generate heat, and a base material supporting the resistive heating layer, wherein a resistance per unit length of the resistive heating layer at opposite sides in a length direction is less than a resistance per unit length of the resistive heating layer at a center portion, and a nip forming unit facing the heating roller to form a fixing nip.

A thickness of the resistive heating layer at the opposite sides may be greater than a thickness of the resistive heating layer at the center portion.

The resistive heating layer may be located at an outer circumferential side of the base material. The base material may be formed as a cylinder having an outer diameter at the center portion, which is greater than an outer diameter at the opposite sides in the length direction.

The resistive heating layer may be located at an inner circumferential side of the base material. The base material may be formed as a cylinder having an inner diameter at the center portion, which is less than an inner diameter at the opposite sides in the length direction.

The resistive heating layer may include a base polymer and an electrically conductive filler dispersed in the base polymer to form an electrically conductive network.

According to exemplary embodiments of the present general inventive concept, a fixing apparatus includes a heating roller, and a nip forming unit facing the heating roller to form a fixing nip, wherein the heating roller may include a resistive heating layer that has a base polymer and an electrically conductive filler dispersed in the base polymer to form an electrically conductive network, and a base material supporting the resistive heating layer, wherein the resistive heating layer may include a paper-through region, through which a recording medium passes, and a non-pass region located at opposite sides of the paper-through region, where the recording medium does not pass through, and where a thickness of the non-pass region is greater than a thickness of the paper-through region.

The resistive heating layer may be located at an outer circumferential side of the base material, and an outer diameter of the base material at a region corresponding to the paper-through region may be greater than an outer diameter of the base material at a region corresponding to the non-pass region.

The resistive heating layer may be located at an inner circumferential side of the base material, and an inner diameter of the base material at a region corresponding to the paper-through region may be less than an inner diameter of the base material at a region corresponding to the non-pass region.

A first insulating layer may be disposed between the base material and the resistive heating layer.

The heating roller may further include a release layer forming an outermost layer. A second insulating layer may be disposed at an inside of the release layer.

The nip forming unit may include a compressing roller that rotates in contact with the heating roller, wherein the compressing roller includes a metal core, an elastic layer formed on an outer circumference of the metal core, and where selected, a release layer.

Alternatively, the nip forming unit may include a belt, a pressing member disposed inside the belt to press the belt toward the heating roller, and an elastic member to provide an elastic force against the pressing member in a direction toward the heating roller.

According to exemplary embodiments of the present general inventive concepts, an electrophotographic image forming apparatus includes a printing unit to form a visible toner image on a recording medium, and the fixing apparatus described above.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
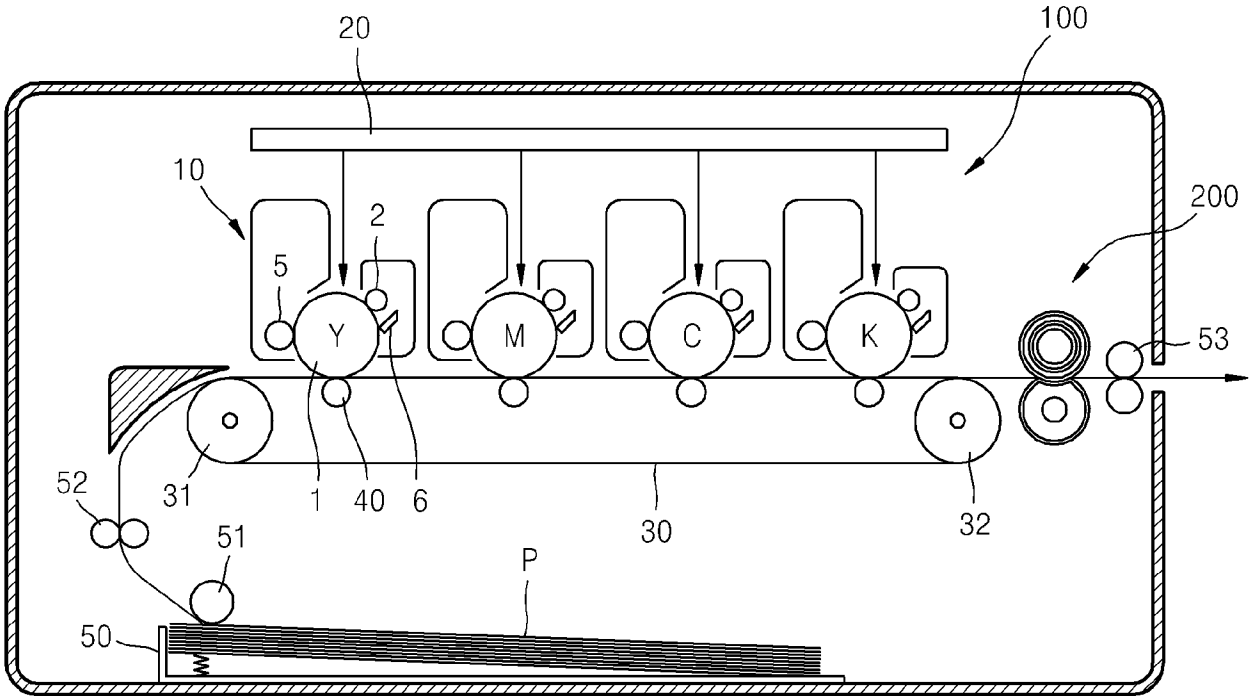
FIG. 1 is a schematic block diagram of an electrophotographic image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a schematic block diagram of an electrophotographic image forming apparatus according to an exemplary embodiment of the present general inventive concept. Referring to FIG. 1, the electrophotographic image forming apparatus includes a printing unit 100 to form a visible toner image on a recording medium P, for example, paper, and a fixing apparatus 200 to fix the toner image to the recording medium P. The printing unit 100, in the present embodiment, forms a color toner image by using an electrophotographic method.

The printing unit 100 may include a plurality of photosensitive drums 1, a plurality of developing devices 10, and a paper-transporting belt 30. The photosensitive drum 1 is an example of a photoreceptor having a surface on which an electrostatic latent image is formed. The photosensitive drum 1 may include a conductive metal pipe and a photosensitive layer, which is formed on an outer circumference of the conductive metal pipe. The plurality of developing devices 10 respectively correspond to the plurality of photosensitive drums 1, and form a toner image on a surface of each of the plurality of photosensitive drums 1 by supplying toner to an electrostatic latent image, formed on the plurality of photosensitive drums 1, and thus developing the electrostatic latent image. Each of the plurality of developing devices 10 may be replaced, separately from the plurality of photosensitive drums 1. Additionally, each of the plurality of developing devices 10 may be in the form of a cartridge that includes the photosensitive drum 1.

With respect to color printing, the plurality of developing devices 10 may include a plurality of developing devices 10Y, 10M, 10C, and 10K that contain yellow (Y), magenta (M), cyan (C), and black (K) toners, respectively. However, the plurality of developing devices 10 are not limited thereto, and may further include developing devices that contain toners of various colors such as light magenta, white, and the like. Hereinafter, an image forming apparatus, which includes the plurality of developing devices 10Y, 10M, 10C, and 10K, is described. Unless otherwise specified, references with Y, M, C, and K refer to elements to print an image by using Y, M, C, and K toners.

The developing device 10 develops an electrostatic latent image into a visible toner image by supplying toner, contained therein, to an electrostatic latent image formed on the photosensitive drum 1. The developing device 10 may include a developing roller 5. The developing roller 5 functions to supply toner in the developing device 10 to the photosensitive drum 1. A developing bias voltage may be applied to the developing roller 5. A regulator, not illustrated, regulates an amount of toner that is supplied to a developing area by the developing roller 5. In the developing area, the photosensitive drum 1 and the developing roller 5 face each other.

In a case of employing a two-component developing method, a magnetic carrier is contained in the developing device 10, and the developing roller 5 is spaced away from the photosensitive drum 1 by a distance ranging from tens to hundreds of microns. Although not illustrated, the developing roller 5 may be formed to include a magnetic roller in a hollow cylindrical sleeve. Toner is attached to a surface of the magnetic carrier. The magnetic carrier is attached to a surface of the developing roller 5 and transported to the developing area in which the photosensitive drum 1 and the developing roller 5 face each other. Only toner is supplied to the photosensitive drum 1 by the developing bias voltage applied between the developing roller 5 and the photosensitive drum 1 so that an electrostatic latent image, formed on a surface of the photosensitive drum 1, is developed into a visible toner image. In the case of employing a two-component developing method, the developing device 10 may include an agitator (not illustrated) to mix and agitate the toner with the magnetic carrier, and transporting the mixed and agitated toner and magnetic carrier to the developing roller 5. The agitator may be, for example, an auger, and the developing device 10 may include a plurality of agitators.

In a case of employing a mono-component developing method in which the magnetic carrier is not used, the developing roller 5 may rotate while in contact with the photosensitive drum 1, or rotate at a position spaced away from the photosensitive drum 1 by a distance of tens through hundreds of microns. The developing device 10 may further include a supply roller (not illustrated) to attach toner to a surface of the developing roller 5. A supply bias voltage may be applied to the supply roller. The developing device 10 may further include an agitator (not illustrated). The agitator may agitate and triboelectrically charge the toner. The agitator may be, for example, an auger.

Element 2 may be a charging roller 2 to charge the photosensitive drum 1 so that the photosensitive drum 1 has a uniform surface potential. Alternatively, element 2 may be a charging brush 2 or a corona charger 2, instead of the charging roller 2.

Element 6 may be a cleaning blade 6 to remove toner and a foreign substance remaining on a surface of the photosensitive drum 1 after a transfer process. Element 6 may be a rotating brush 6, a different type of cleaning device, instead of the cleaning blade 6.

An example of a developing method used by an image forming apparatus, according to an exemplary embodiment of the present general inventive concept, is specifically described. However, the present general inventive concept is not limited thereto, and various modifications and changes may be made, with respect to a developing method.

An exposing unit 20 emits light, modulated in correspondence to image information, to photosensitive drums 1Y, 1M, 1C, and 1K, so as to form electrostatic latent images that respectively correspond to Y, M, C, and K images on the photoconductive drums 1Y, 1M, 1C, and 1K. An example of the exposing unit 20 may include a laser scanning unit (LSU), which uses a laser diode as a light source, and a light-emitting diode (LED) scanning unit, which uses an LED as a light source.

The paper-transporting belt 30 supports and transports the recording medium P. The paper-transporting belt 30 may be supported by, for example, supporting rollers 31 and 32, and circulates to pass paper between a plurality of transfer rollers 40 and a plurality of photosensitive drums. A plurality of transfer rollers 40 are disposed to respectively face the plurality of photosensitive drums 1Y, 1M, 1C, and 1K with the paper-transporting belt 30 therebetween. The plurality of transfer rollers 40 are an example of a transfer unit, which transfers a toner image from the plurality of photosensitive drums 1Y, 1M, 1C, and 1K to the recording medium P supported by the paper-transporting belt 30. A transfer bias voltage is applied to the plurality of transfer rollers 40, so as to transfer a toner image to the recording medium P. Element 40 may represent a corona transfer unit 40, a pin-scorotron type transfer unit 40 or a transfer roller 40.

Recording medium P may be picked up from a recording medium tray 50 by a pick-up roller 51, transported by a pair of transporting rollers 52, and then, be attached to the paper-transporting belt 30, for example, by an electrostatic force.

The fixing apparatus 200 applies heat and/or pressure to the image transferred to the recording medium P, thus fixing the image to the recording medium P. The recording medium P, passing through the fixing apparatus 200, is discharged by a pair of discharge rollers 23.

Based on the configuration described above, the exposing unit 20 emits light, modulated in correspondence to image information of each color, to the plurality of photosensitive drums 1Y, 1M, 1C, and 1K, so as to form an electrostatic latent image. The plurality of developing devices 10Y, 10M, 10C, and 10K respectively supply the yellow Y, magenta M, cyan C, and black K toners to the electrostatic latent image, formed on the plurality of photosensitive drums 1Y, 1M, 1C, and 1K, thus forming visible toner images respectively on a surface of the plurality of photosensitive drums 1Y, 1M, 1C, and 1K. The recording medium P, loaded on the recording medium tray 50, is supplied to the paper-transporting belt 30 by the pick-up roller 51 and the pair of transporting rollers 52 and maintained on the paper-transporting belt 30, for example, by using an electrostatic force. The toner images of yellow Y, magenta M, cyan C, and black K are sequentially transferred to the recording medium P, which is transported by the paper-transporting belt 30, by applying a transfer bias voltage to the transfer roller 40. When the recording medium P passes through the fixing apparatus 200, the toner image is fixed on the recording medium P by heat and pressure. The recording medium P, on which the toner image is completely fixed, is discharged by the pair of discharge rollers 53.

The electrophotographic image forming apparatus of FIG. 1 employs a method of directly transferring a toner image, which is developed on the plurality of photoconductive drums 1Y, 1M, 1C, and 1K, to the recording medium P supported by the paper-transporting belt 30. However, the present general inventive concept is not limited thereto. For example, a method of intermediately transferring a toner image, developed on the plurality of photosensitive drums 1Y, 1M, 1C, and 1K, to an intermediate transfer belt, and then, transferring the toner image to the recording medium P may be used. The intermediate transferring method is well known to one of ordinary skill in the art. Thus, detailed description thereof is not provided here.

Figure 2:
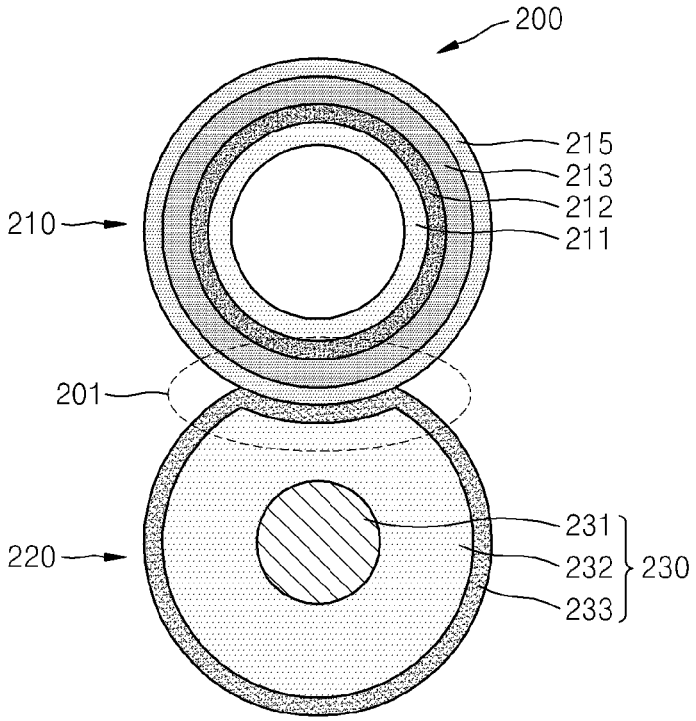
FIG. 2 is a cross-sectional view of a fixing apparatus according to an exemplary embodiment of the present general inventive concept.
Figure 3:
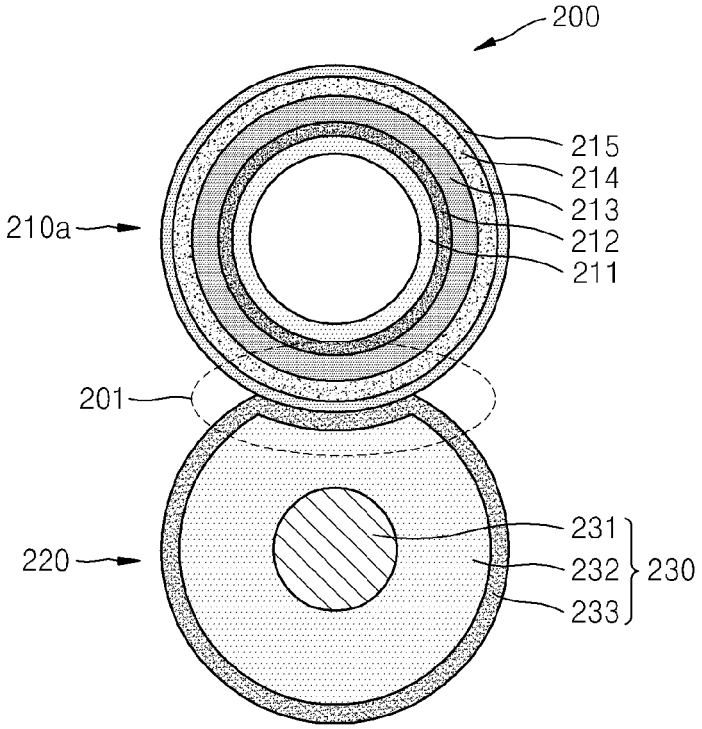
FIG. 3 is a cross-sectional view of a fixing apparatus according to an exemplary embodiment of the present general inventive concept.

FIGS. 2 and 3 are schematic cross-sectional views of the fixing apparatus 200. Referring to FIGS. 2 and 3, the fixing apparatus 200 may include heating rollers 210 and 210*a* that rotate, and a nip forming unit 220. The nip forming unit 220 faces the heating rollers 210 and 210*a* to form a fixing nip 201.

The nip forming unit 220 may include a compressing roller 230 that rotates in contact with the heating rollers 210 and 210*a*. The compressing roller 230 may include, for example, a metal core 231 and an elastic layer 232 formed on an outer circumference of the metal core 231. A release layer 233 may be further formed on an outer circumference of the elastic layer 232. The elastic layer 232 may be a heat-resistant elastomer layer. The heat-resistant elastomer may be, for example, silicon elastomer or fluoride elastomer. The release layer 233 may be a resin layer having an isolation property that is greater than a predetermined amount. The release layer 233 may be formed of one or a blend of two or more of perfluoroalkoxy (PFA), polytetrafluoroethylenes (PTFE), and fluorinated ethylene propylene (FEP), or a copolymer thereof.

To form the fixing nip 201, elastic forces may be applied to the heating rollers 210 and 210*a* and/or the compressing roller 230 toward each other. Thus, the elastic layer 232 of the compressing roller 230 is partially transformed (contracted) to form the fixing nip 201. According to the above configuration, when the heating rollers 210 and 210*a* and the compressing roller 230 rotate, the recording medium P entering the fixing nip 201 may be conveyed.

Figure 4:
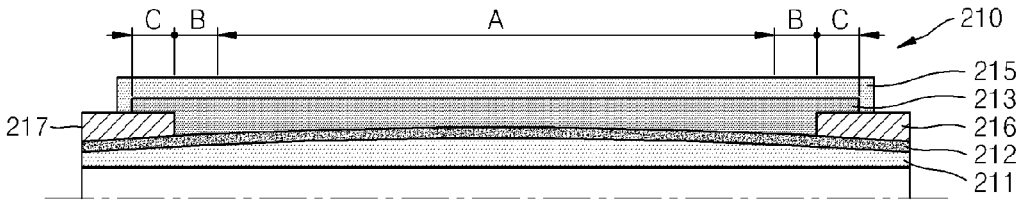
FIG. 4 is a transverse sectional view of a heating roller illustrated in FIG. 2.
Figure 5:
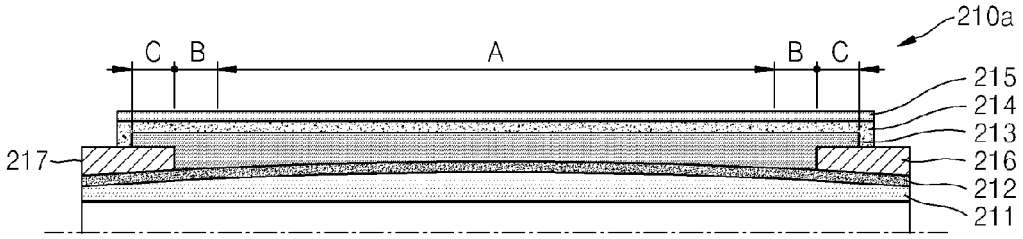
FIG. 5 is a transverse sectional view of a heating roller illustrated in FIG. 3.

FIGS. 4 and 5 are transverse sectional views of the heating rollers 210 and 210*a* illustrated in FIGS. 2 and 3. Referring to FIGS. 2 through 5, each of the heating rollers 210 and 210*a* may include a resistive heating layer 213, and a base material 211 supporting the resistive heating layer 213. A first insulating layer 212 that is an electric insulating layer may be disposed between the base material 211 and the resistive heating layer 213. Electrodes 216 and 217 to supply electric current to the resistive heating layer 213 are disposed at opposite end portions of the heating roller 210 or 210*a* in a length direction. The electrodes 216 and 217 may be formed of low-resistive metal, and may be located on the first insulating layer 212. In a case where the base material 211 is an electric insulating material, although not illustrated in FIGS. 2 through 5, the electrodes 216 and 217 may be located on an outer circumferential surface of the base material 211. The electrodes 216 and 217 contact the opposite end portions of the resistive heating layer 213 in a length direction, and parts of the electrodes 216 and 217 are exposed so that a power supply device (not illustrated) may be connected thereto. In order to increase separatability between the heating roller 210 or 210*a* and the recording medium P, a release layer 215 may be formed on an outermost layer of the heating roller 210 or 210*a*. As illustrated in FIGS. 3 and 5, the heating roller 210*a* may further include a second insulating layer (or an elastic insulating layer) 214 that is an electric insulating layer that is located inside the release layer 215, that is, between the release layer 215 and the resistive heating layer 213. If the release layer 215 has a sufficient withstanding voltage property, the second insulating layer (or elastic insulating layer) 214 may be omitted as in the heating roller 210 illustrated in FIGS. 2 and 4.

The base material 211 may have heat resistance and rigidity that may bear pressure to form the fixing nip 201. The base material 211 may be a plastic material, for example, polypropylene sulfide (PPS), a ceramic material such as alumina ($Al_2O_3$), or a metal material such as killed steel, i.e., steel that has been completely deoxidized by the addition of an agent such as silicon or aluminium, before casting, so that there is virtually no evolution of gas during solidification so as to be characterized by a high degree of chemical homogeneity and freedom from porosity, and may be formed as a cylindrical rod or a hollow pipe shape.

The resistive heating layer 213 may be a metal heating layer formed of, for example, an Ag—Pd alloy, an Ag—Pt alloy, or an Ni—Sn alloy. The above metal alloy layer may be formed by applying the Ag—Pd alloy, the Ag—Pt alloy, or Ni—Sn alloy onto a surface of the base material 211.

Also, the resistive heating layer 213 may include a base polymer, and an electrically conductive filler dispersed in the base polymer. The base polymer may be any kind of material that has heat-resistance that may bear a fixing temperature. For example, the base polymer may be a heat-resistant resin or a heat-resistant elastomer. The heat-resistant resin may be polyimide or polyimide-amide. The heat-resistant elastomer may be silicon elastomer, fluoride elastomer, or the like. The base polymer may be one of the above materials, or a blend or a copolymer of two or more among the above materials.

One or more kinds of electrically conductive filler may be dispersed in the base polymer. The electrically conductive filler may be a metal filler such as metal particles or a carbon-based filler. The carbon-based filler may be, for example, carbon black, carbon nanotube (CNT), cup-stacked carbon nanotube, carbon fiber, carbon nanofiber, carbon nanocoil, fullerene, graphite, expanded graphite, graphite nano platelet, graphite oxide (GO). The electrically conductive filler may be a combination of one or more of these materials. As an exemplary embodiment, when multi-walled carbon nanotube (MWNT) is used as the electrically conductive filler, a content amount of the electrically conductive filler may be about 10 to about 40 wt %.

As an exemplary embodiment, a precursor of the base polymer is dissolved in an organic solvent that has high chemical affinity to the base polymer to form a solution, and the electrically conductive filler is dispersed in the solution. The solution is applied to an outer circumferential surface of the base material 211 (a surface of the first insulating layer 212 when there is the first insulating layer 212) and surfaces of the electrodes 216 and 217, and then, a thermal treatment is performed. During the thermal treatment, the solvent is discomposed, and the polymer precursor becomes a solid polymer. Here, the solid polymer has a strong adhesive force with respect to the electrically conductive filler dispersed therein, and thus, the electrically conductive filler is fixed in the polymer. Thus, the electrically conductive filler is prevented from moving in the base polymer. Additionally, since a structure of an electrically conductive filler to form the electrically conductive network, for example, a graphene structure with $\pi$-$\pi^*$ bonding is not destroyed, a heating element with an excellent reactivity to an input voltage, that is, a heating speed, may be obtained. Also, by performing the process, the resistive heating layer 213 and the electrodes 216 and 217 may be bonded to each other without using a conductive primer. Accordingly, the heating rollers 210 and 210*a* having a low contact resistance between the resistive heating layer 213 and the electrodes 216 and 217 and an excellent adhesive force may be obtained.

The electrically conductive filler is dispersed within the base polymer to form an electrically conductive network. As such, the resistive heating layer 213 may be an electrical conductor or a resistor. For example, since the CNT has a conductivity similar to metal but a very low density, a heat capacity per unit volume of the CNT is 3 to 4 times lower than that of general heat resistant materials, so that the resistive heating layer 213, which employs the CNT as a conductive filler, may have a very rapid change in temperature. Accordingly, by using such a type of the heating roller 210 or 210*a* adopting the resistive heating layer 213, a time to switch from a standby mode to a printing mode may be reduced, and thus, first printing may be performed in a reduced time.

The first insulating layer 212 may be a polymer layer having high heat resistance and an electric insulating property. For example, the first insulating layer 212 may be a polyimide (PI) resin layer. The first insulating layer 212 may have a withstanding voltage property of about, for example, 3 kV or higher. The polyimide resin layer may have a thickness of about 20 to about 70 μm. Based on withstanding voltage tests, the polyimide resin layer has a withstanding voltage property of about 3 kV or greater when its thickness is about 20 μm or greater, and thus, the thickness of the polyimide resin layer may be set as about 20 μm or greater in consideration of the withstanding voltage property and about 70 μm or less in consideration of thermal conductivity. In an exemplary embodiment, the thickness of the polyimide resin layer as the first insulating layer 212 may be set as ranging from about 20 to about 50 μm.

The first insulating layer 212 may be attached to the outer circumferential surface of the base material 211 by using a primer. For example, a polyimide tube as the first insulation layer 212 may be attached to the outer circumferential surface of the base material 211, on which the primer is applied. Alternatively, a solution of polyimide precursor is applied to the outer circumferential surface of the base material 211 and a hardening thermal treatment is performed to directly attach the polyimide to the base material 211.

When a metal alloy layer is used as the resistive heating layer 213, a process performed at a high temperature, for example, about 600° C. or higher, may be used to form the metal alloy layer. Thus, in this case, an organic layer such as polyimide may not be used as the first insulating layer 212 but rather, a ceramic layer such as $Al_2O_3$ layer may be used as the first insulating layer 212.

The release layer 215 forms an outermost layer of the heating roller 210 or 210*a*. During the fixing process, an offset, in which toner on the recording medium P melts and attaches to the heating roller 210 or 210*a*, may result. The offset may cause inferior printing in which a part of a printing image on the recording medium P is missing or a jam in which the recording medium P, passing through the fixing nip 201, is not separated from the heating roller 210 or 210*a* and is attached to an outer surface of the heating roller 210 or 210*a*. The release layer 215 may be a resin layer having excellent separation characteristics, for example, a fluoride resin layer. The fluoride resin may be, for example, one of materials such as perfluoroalkoxy (PFA), polytetrafluoroethylene (PTFE), and fluorinated ethylene propylene (FEP), a blend of two or more of the materials, or a copolymer thereof. The release layer 215 may be formed by covering the resistive heating layer 213 with a tube, made of the materials described above, or coating the materials described above on a surface of the resistive heating layer 213. A thickness of the release layer 215 may be, for example, about 30 to about 80 μm, in consideration of the withstanding voltage property that the heating roller 210 or 210*a* is required to have. If there is no second insulating layer (elastic insulating layer) 214, the release layer 215 may completely surround opposite end portions of the resistive heating layer 213 as illustrated in FIG. 4.

As illustrated in FIGS. 3 and 5, the second insulating layer (or elastic insulating layer) 214 may be disposed between the resistive heating layer 213 and the release layer 215. The second insulating layer 214 may be a polyimide layer, like the first insulating layer 212. The second insulating layer 213 may have a thickness that is less than that of the first insulating layer 212, in consideration of thermal transfer to the recording medium P. For example, the second insulating layer 214 may have a thickness of about 10 to about 50 μm.

The second insulating layer 214 may be replaced with an elastic insulating layer. The elastic insulating layer grants elasticity to the heating roller 210 or 210*a* so that the fixing nip 201 may be easily formed, and may be formed of a material having an electric insulation and heat resistance against the fixing temperature. For example, the elastic insulating layer may be formed of rubber such as fluoro rubber, silicone rubber, natural rubber, isoprene rubber, butadiene rubber, nitrile rubber, chloroprene rubber, butyl rubber, acrylic rubber, hydrin rubber, and urethane rubber, and may also be formed of one of various thermoplastic elastomers such as stylenes, polyolefins, polyvinyl chlorides, polyurethanes, polyamides, polybutadienes, trans-polyisoprenes, and chlorinated polyethylenes, or a blend or a copolymer thereof. A thickness of the elastic insulating layer may be, for example, about 10 to about 100 μm.

The second insulating layer (elastic insulating layer) 214 may completely surround the opposite end portions of the resistive heating layer 213 as illustrated in FIG. 5.

According to the fixing apparatus adopting the heating roller 210 or 210*a*, the resistive heating layer 213 on the heating roller 210 or 210*a* directly transfers the thermal energy to the recording medium P, and thus, temperature rises rapidly, a thermal efficiency may be improved, and power consumption during the fixing process may be reduced.

Referring to FIGS. 4 and 5, the resistive heating layer 213 may be partitioned into a paper-through region A through which the recording medium P passes, a non-pass region B located at an outer portion of the paper-through region A, and an electrode contact region C located at an outer portion of the non-pass region B and where the electrodes 216 and 217 and the resistive heating layer 213 contact each other. During the fixing process, since the recording medium P does not pass through the non-pass region B, the heat generated by the resistive heating layer 213 does not transfer to the recording medium P in the non-pass region B. Thus, when adjusting heating amount of the resistive heating layer 213 so as to maintain the temperature of the paper-through region A at a desired fixing temperature, the non-pass region B may be over-heated to a temperature higher than the fixing temperature. Since the heat generated from the electrode contact region C is transferred to the outside via the electrodes 216 and 217, possibility of over-heating the electrode contact region C is relatively lower than that of the non-pass region B. The over-heating of the non-pass region B degrades physical properties of material layers forming the heating roller 210 or 210*a*, thereby causing problems such as fixing property degradation and durability degradation of the heating roller 210 or 210*a*.

In order to minimize the over-heating of the non-pass region B, a heating value of the non-pass region B (opposite ends of the resistive heating layer 213) per unit length may be set to be less than that of the paper-through region A (center portion of the resistive heating layer 213). Since an amount of electric current flowing in the resistive heating layer 213 is determined by an entire resistance of the resistive heating layer 213, a resistance value of the non-pass region B per unit length is set to be less than that of the paper-through region A per unit length so that the heating value of the non-pass region B may be less than that of the paper-through region A. The resistance value is in inverse proportion to a cross-sectional area of the material where the resistance occurs. Thus, as illustrated in FIGS. 4 and 5, a thickness of the non-pass region B is formed to be greater than that of the paper-through region A so that the resistance value of the non-pass region B per unit length may be less than that of the paper-through region A. That is, the thickness of the resistive heating layer 213 at the opposite end portions is greater than that of the center portion in the length direction. That is, the thickness of the resistive heating layer 213 may be gradually increased from the center portion toward the opposite end portions in the length direction. Otherwise, the thickness of the resistive heating layer 213 is constant from the center portion to a predetermined region in the length direction, for example, until reaching a boundary between the paper-through region A and the non-pass region B, and then, may be increased toward the opposite end portions. For example, the thickness of the non-pass region B of the resistive heating layer 213 may be greater than that of the paper-through region A by about 0.001 to 0.25 mm. The thickness of the resistive heating layer 213 at the center portion may be, for example, about 10 to about 100 μm.

Figure 6:
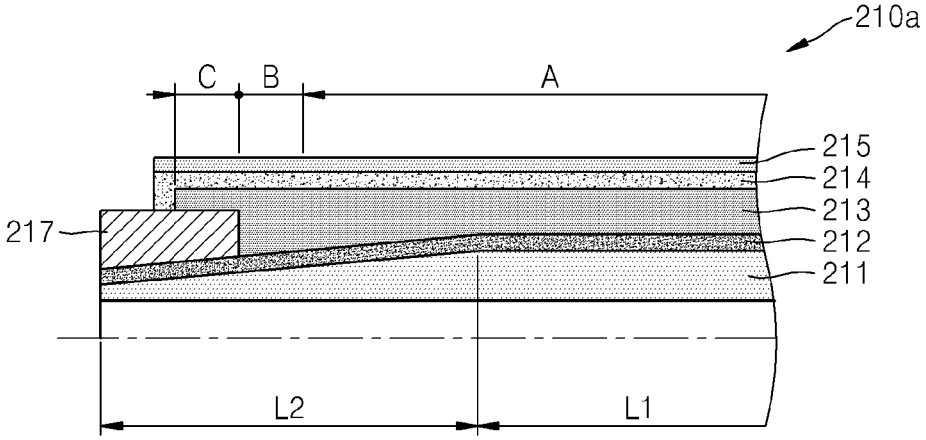
FIG. 6 is a transverse sectional view of the heating roller illustrated in FIG. 3.

In order to increase the thickness of the non-pass region B to be greater than that of the paper-through region A, the base material 211 may have an outer diameter at a center portion thereof, which is greater than an outer diameter of opposite end portions thereof. The base material 211 may be formed as a crown with a convex center portion. The base material 211 may have a shape, the outer diameter of which is gradually reduced from the center portion toward opposite end portions in the length direction thereof. Also, as illustrated in FIG. 6, the outer diameter of the base material 211 may be constant from the center portion to a predetermined point (region L1), for example, to a boundary between the paper-through region A and the non-pass region B, in the length direction, and may be reduced toward the opposite end portions in a region L2. A difference between the outer diameter of the base material 211 at the center portion and the opposite end portions may be about 0.002 to about 0.5 mm.

As described above, by setting the heating value of the non-pass region B to be less than that of the paper-through region A, the problem caused by the over-heating of the non-pass region B, for example, durability degradation of the heating roller 210 or 210*a*, may be prevented.

Figure 7:
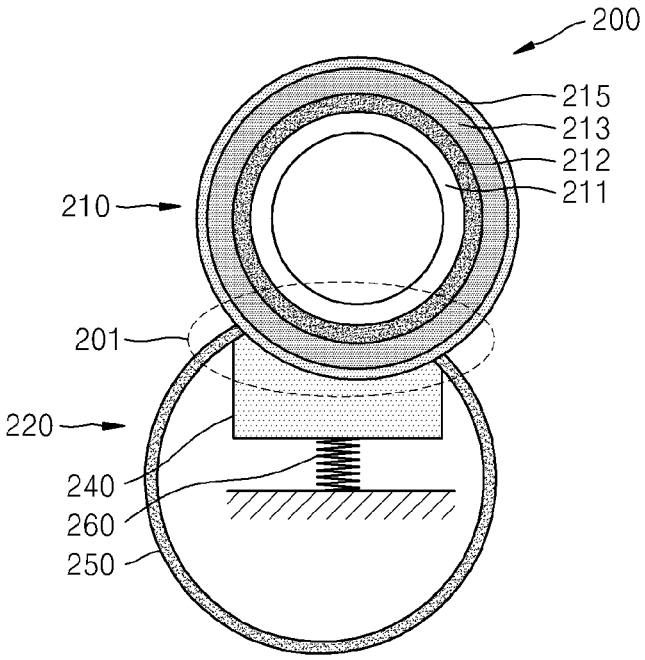
FIG. 7 is a cross-sectional view of a fixing apparatus according to an exemplary embodiment of the present general inventive concept.
Figure 8:
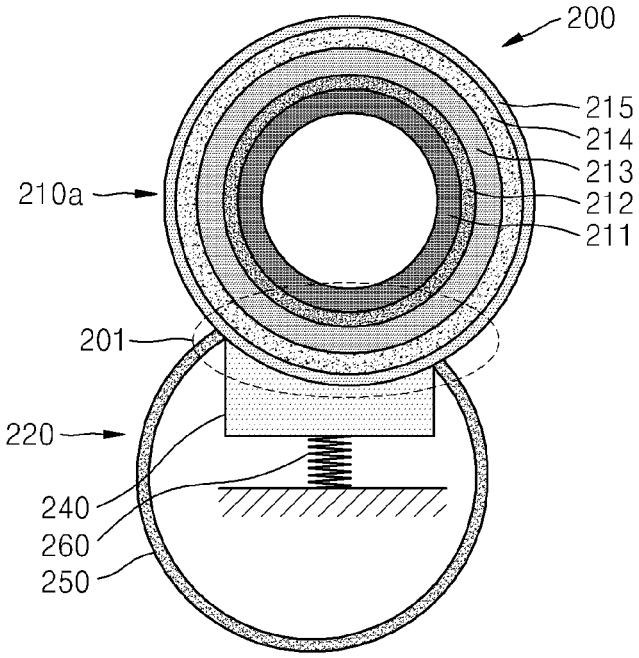
FIG. 8 is a cross-sectional view of a fixing apparatus according to an exemplary embodiment of the present general inventive concept.

FIGS. 7 and 8 are cross-sectional views of another example of the fixing apparatus 200. Referring to FIGS. 7 and 8, a nip forming unit 220 using a belt 250 is used, unlike the fixing apparatus 200 illustrated in FIGS. 2 and 3. The nip forming unit 220 may include the belt 250, and a pressing member 240 disposed inside the belt 250 to press the belt 250 toward the heating roller 210 or 210*a*. An elastic member 260 provides an elastic force against the pressing member 240 in a direction toward the heating roller 210 or 210*a* to form the fixing nip 201.

Figure 9:
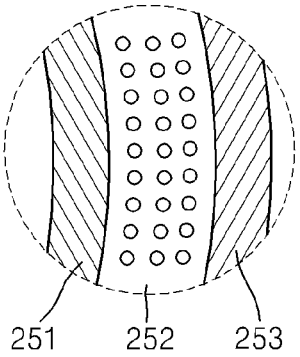
FIG. 9 is a cross-sectional view of a belt according to an exemplary embodiment of the present general inventive concept.

FIG. 9 is a cross-sectional view of the belt 250 according to the present exemplary embodiment. Referring to FIG. 9, the belt 250 may include a heat-resistant base material 251. The base material 251 may be a metal thin film such as a stainless steel thin film or a nickel thin film, or a polymer film having heat resistance to the fixing temperature, for example, a temperature ranging from 120° C. to 200° C., and abrasion resistance. The polymer film may be a polyimide film, polyamide film, or polyimide-amide film. A thickness of the base material 251 may be determined to have flexibility and elasticity so that the belt 250 may be flexibly deformed at the fixing nip 201 and, after passing through the fixing nip 201, return to an original state. An elastic layer 252 may be further formed on an outer side of the base material 251. An outermost layer of the belt 250 may be a release layer 253 in order to prevent toner from being attached to an outer circumferential surface of the belt 250. The elastic layer 252 may be a heat-resistant elastomer layer. The heat-resistant elastomer may be, for example, silicon elastomer or fluoride elastomer. The release layer 253 may be a resin layer that has separation characteristics that are greater than a predetermined amount. The release layer 253 may be, for example, one of materials such as perfluoroalkoxy (PFA), polytetrafluoroethylene (PTFE), and fluorinated ethylene propylene (FEP), a blend of two or more of the materials, or a copolymer thereof.

According to the above configuration, since a heat capacity of the belt 250 is less than that of the pressing roller 230, an amount of heat transferred from the heating roller 210 or 210*a* to the nip forming unit 220 may be reduced, thereby obtaining a high thermal efficiency.

Figure 10:
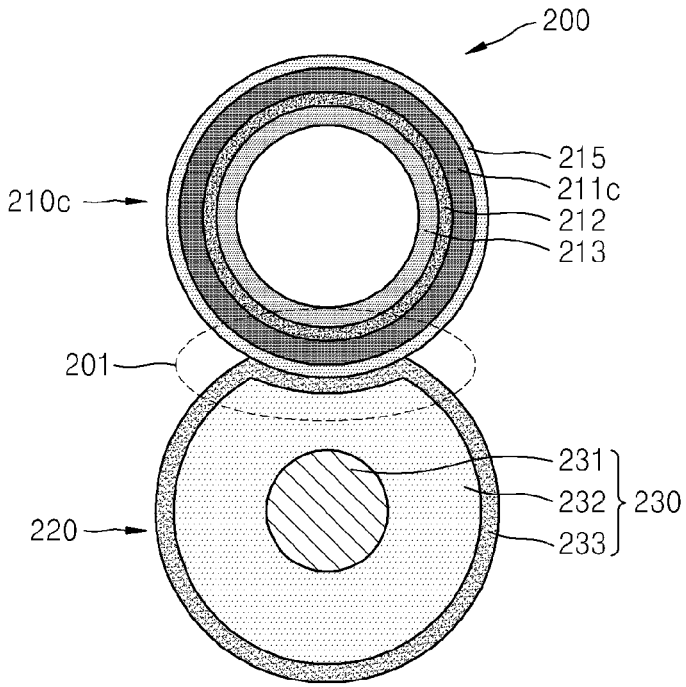
FIG. 10 is a cross-sectional view of a fixing apparatus according to an exemplary embodiment of the present general inventive concept.
Figure 11:
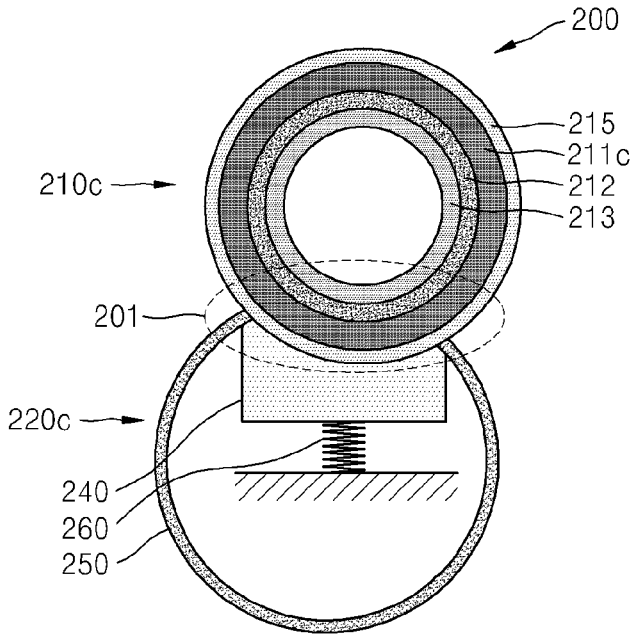
FIG. 11 is a cross-sectional view of a fixing apparatus according to an exemplary embodiment of the present general inventive concept.
Figure 12:
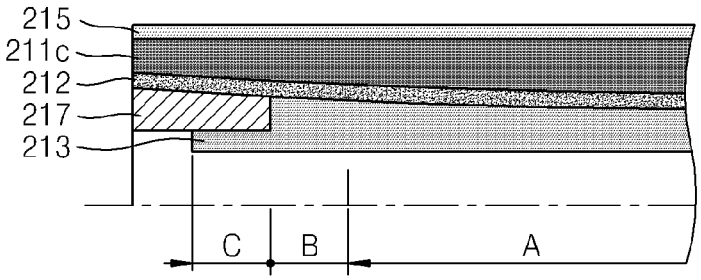
FIG. 12 is a transverse sectional view of a heating roller illustrated in FIG. 11.

FIGS. 10 and 11 are cross-sectional views of another example of the fixing apparatus 200. FIG. 12 is a transverse sectional view of a heating roller illustrated in FIGS. 10 and 11. The fixing apparatus 200 illustrated in FIGS. 2, 3, 7, and 8 adopts the heating roller 210 or 210*a*, in which the resistive heating layer 213 is disposed at an outer circumferential side of the base material 211. However, in the fixing apparatus 200 illustrated in FIGS. 10 and 11, the resistive heating layer 213 employs a heating roller 200*c* disposed at an inner circumferential side of a base material 211*c*. Referring to FIGS. 10, 11, and 12, the heating roller 210*c* includes the base material 211*c*, and the resistive heating layer 213 disposed at the inner circumferential side of the base material 211*c*. A first insulating layer 212 may be disposed between the base material 211*c* and the resistive heating layer 213. A release layer 215 may be disposed on an outer circumference of the base material 211*c*.

As described above, the thickness of the non-pass region B of the resistive heating layer 213 may be greater than that of the paper-through region A of the resistive heating layer 213 as illustrated in FIG. 12, in order to prevent over-heating of the non-pass region B. The resistive heating layer 213 may have a thickness at the opposite end portions thereof greater than that of the center portion thereof in the length direction. The thickness of the resistive heating layer 213 may be gradually increased from the center portion toward the opposite end portions in the length direction. Otherwise, the thickness of the resistive heating layer 213 is constant from the center portion to a predetermined region in the length direction, for example, to a boundary between the paper-through region A and the non-pass region B, and then, may be increased toward the opposite end portions. For example, the thickness of the non-pass region B of the resistive heating layer 213 may be greater than that of the paper-through region A by about 0.001 to 0.25 mm. The thickness of the resistive heating layer 213 at the center portion may be, for example, about 10 to about 100 μm.

As illustrated in FIG. 12, in order to increase the thickness of the non-pass region B of the resistive heating layer 213 to be greater than that of the paper-through region A of the resistive heating layer 213, the base material 211*c* may have an inner diameter at a center portion thereof that is less than an inner diameter of opposite end portions thereof. The base material 211*c* may be formed as an inversed crown with a convex center portion toward the inside thereof. The base material 211*c* may have a shape, the inner diameter of which is gradually increased from the center portion toward opposite end portions in the length direction thereof. Also, the inner diameter of the base material 211*c* may be constant from the center portion to a predetermined point, for example, to a boundary between the paper-through region A and the non-pass region B, in the length direction, and may be increased toward the opposite end portions. A difference between the outer diameter of the base material 211*c* at the center portion and the opposite end portions may be about 0.002 to about 0.5 mm.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A fixing apparatus comprising:

a heating roller comprising a resistive heating layer receiving an electric current to generate heat, and a base material supporting the resistive heating layer, wherein a resistance per unit length of the resistive heating layer at opposite sides in a length direction is less than a resistance per unit length of the resistive heating layer at a center portion; and a nip forming unit facing the heating roller to form a fixing nip, wherein a thickness of the resistive heating layer at the opposite sides is greater than a thickness of the resistive heating layer at the center portion.

2. The fixing apparatus of claim 1, wherein the resistive heating layer is located at an outer circumferential side of the base material.

3. The fixing apparatus of claim 2, wherein the base material is formed as a cylinder having an outer diameter at the center portion, which is greater than an outer diameter at the opposite sides in the length direction.

4. The fixing apparatus of claim 1, wherein the resistive heating layer is located at an inner circumferential side of the base material.

5. The fixing apparatus of claim 4, wherein the base material is formed as a cylinder having an inner diameter at the center portion, which is less than an inner diameter at the opposite sides in the length direction.

6. The fixing apparatus of claim 1, wherein the resistive heating layer comprises a base polymer and an electrically conductive filler dispersed in the base polymer to form an electrically conductive network.

7. The fixing apparatus of claim 1, wherein a first insulating layer is disposed between the base material and the resistive heating layer.

8. The fixing apparatus of claim 1, wherein the heating roller further comprises a release layer forming an outermost layer.

9. The fixing apparatus of claim 8, wherein a second insulating layer is disposed inside of the release layer.

10. The fixing apparatus of claim 1, wherein the nip forming unit comprises:

a compressing roller that rotates in contact with the heating roller, wherein the compressing roller includes a metal core, an elastic layer formed on an outer circumference of the metal core, and where selected, a release layer.

11. The fixing apparatus of claim 1, wherein the nip forming unit comprises:

a belt, a pressing member disposed inside the belt to press the belt toward the heating roller, and an elastic member to provide an elastic force against the pressing member in a direction toward the heating roller.

12. A fixing apparatus comprising:

a heating roller; and a nip forming unit facing the heating roller to form a fixing nip, wherein the heating roller comprises:

a resistive heating layer comprising a base polymer and an electrically conductive filler dispersed in the base polymer to form an electrically conductive network; and a base material supporting the resistive heating layer, wherein the resistive heating layer comprises a paper-through region, through which a recording medium passes, and a non-pass region located at opposite sides of the paper-through region and where the recording medium does not pass through, and a thickness of the non-pass region is greater than a thickness of the paper-through region.

13. The fixing apparatus of claim 12, wherein the resistive heating layer is located at an outer circumferential side of the base material, and an outer diameter of the base material at a region corresponding to the paper-through region is greater than an outer diameter of the base material at a region corresponding to the non-pass region.

14. The fixing apparatus of claim 12, wherein the resistive heating layer is located at an inner circumferential side of the base material, and an inner diameter of the base material at a region corresponding to the paper-through region is less than an inner diameter of the base material at a region corresponding to the non-pass region.

15. The fixing apparatus of claim 12, wherein a first insulating layer is disposed between the base material and the resistive heating layer.

16. The fixing apparatus of claim 12, wherein the heating roller further comprises a release layer forming an outermost layer.

17. The fixing apparatus of claim 16, wherein a second insulating layer is disposed inside of the release layer.

18. An electrophotographic image forming apparatus comprising:

a printing unit to form a visible toner image on a recording medium; and a fixing apparatus comprising:

a heating roller comprising a resistive heating layer receiving an electric current to generate heat, and a base material supporting the resistive heating layer, wherein a resistance per unit length of the resistive heating layer at opposite sides in a length direction is less than a resistance per unit length of the resistive heating layer at a center portion; and a nip forming unit facing the heating roller to form a fixing nip, wherein the resistive heating layer comprises a base polymer and an electrically conductive filler dispersed in the base polymer to form an electrically conductive network.

19. The electrophotographic image forming apparatus of claim 18, wherein a thickness of the resistive heating layer at the opposite sides is greater than a thickness of the resistive heating layer at the center portion.

20. An electrophotographic image forming apparatus comprising:

a printing unit to form a visible toner image on a recording medium; and a fixing apparatus comprising:

a heating roller; and a nip forming unit facing the heating roller to form a fixing nip, wherein the heating roller comprises:

a resistive heating layer comprising a base polymer and an electrically conductive filler dispersed in the base polymer to form an electrically conductive network; and a base material supporting the resistive heating layer, wherein the resistive heating layer comprises a paper-through region, through which a recording medium passes, and a non-pass region located at opposite sides of the paper-through region and where the recording medium does not pass through, and a thickness of the non-pass region is greater than a thickness of the paper-through region.

* * * * *